US010240852B2

(12) United States Patent
Uselton et al.

(10) Patent No.: US 10,240,852 B2
(45) Date of Patent: Mar. 26, 2019

(54) ICE SENSOR FOR A HEAT PUMP

(71) Applicant: Lennox Industries Inc., Richardson, TX (US)

(72) Inventors: Robert B. Dutch Uselton, Plano, TX (US); Jonathan Douglas, Lewisville, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 15/799,645

(22) Filed: Oct. 31, 2017

(65) Prior Publication Data

US 2018/0051925 A1 Feb. 22, 2018

Related U.S. Application Data

(63) Continuation of application No. 13/690,561, filed on Nov. 30, 2012, now Pat. No. 9,816,745.

(51) Int. Cl.
*F25D 21/02* (2006.01)
*F25D 21/06* (2006.01)

(52) U.S. Cl.
CPC ..... *F25D 21/02* (2013.01); *F25D 21/06* (2013.01)

(58) Field of Classification Search
CPC ..... F25D 21/02; F25D 21/06
USPC ..... 62/80
See application file for complete search history.

(56) References Cited

U.S. PATENT DOCUMENTS 3,614,345 A 10/1971 Quinn
4,333,004 A 6/1982 Forgue et al.
4,481,787 A * 11/1984 Lynch ..... F25D 11/02 236/46 R
4,586,828 A * 5/1986 Winter ..... F25B 41/062 374/15
4,607,153 A * 8/1986 Ang ..... F02P 19/025 123/179.21
4,671,072 A * 6/1987 Starck ..... G01N 25/18 219/505
4,689,965 A * 9/1987 Janke ..... F25D 21/006 62/155
4,808,009 A * 2/1989 Sittler ..... F25D 21/02 338/22 SD
4,916,912 A * 4/1990 Levine ..... F25B 47/025 62/155
5,345,775 A 9/1994 Ridenour
(Continued)

FOREIGN PATENT DOCUMENTS

JP H01312378 12/1989
JP H0926407 1/1997

OTHER PUBLICATIONS

PCT International Search Report for related PCT/US2013/071741, dated Feb. 28, 2014, 5 pages.
(Continued)

*Primary Examiner* — Henry T Crenshaw
(74) *Attorney, Agent, or Firm* — Baker Botts L.L.P.

(57) ABSTRACT

In various implementations, an ice sensor may include heater(s), ice accumulation surface(s), and/or temperature sensor(s). During operation, heat from a heater may be provided to an ice accumulation surface and a temperature sensor(s) may determine temperature(s) of the ice accumulation surface. A determination of whether ice is present on the ice sensor may be based at least partially on the determined temperature(s).

19 Claims, 2 Drawing Sheets

(56) References Cited

U.S. PATENT DOCUMENTS

| | | | | |
|---|---|---|---|---|
| 6,080,973 | A * | 6/2000 | Thweatt, Jr. | F24H 9/0047 219/497 |
| 6,201,930 | B1 | 3/2001 | Close et al. | |
| 6,446,505 | B1 | 9/2002 | Wieszit | |
| 6,694,754 | B1 | 2/2004 | Schenk et al. | |
| 6,958,463 | B1 * | 10/2005 | Kochman | H05B 3/56 219/494 |
| 2001/0012485 | A1 * | 8/2001 | Gaudet | F04B 37/08 417/53 |
| 2001/0045098 | A1 | 11/2001 | Derryberry et al. | |
| 2004/0178188 | A1 * | 9/2004 | Matsunaga | B60H 1/2221 219/481 |
| 2005/0160754 | A1 * | 7/2005 | Hugh | F25D 17/047 62/275 |
| 2010/0326096 | A1 | 12/2010 | Junge et al. | |
| 2011/0225993 | A1 * | 9/2011 | Fotiadis | F25D 21/002 62/80 |
| 2014/0150478 | A1 | 6/2014 | Uselton et al. | |

OTHER PUBLICATIONS

PCT Written Opinion of the International Search Authority for related PCT/US2013/071741, dated Feb. 28, 2014, 4 pages.

* cited by examiner

ICE SENSOR FOR A HEAT PUMP

CROSS REFERENCE TO RELATED INFORMATION

This application is a continuation of U.S. patent application Ser. No. 13/690,561, filed Nov. 30, 2012, titled Ice Sensor for a Heat Pump, now U.S. Pat. No. 9,816,745 the contents of which are hereby incorporated herein in its entirety.

TECHNICAL FIELD

The present disclosure relates to ice sensors, and more particularly to ice sensors for heat pumps.

BACKGROUND OF THE INVENTION

When a heat pump operates in cold temperatures, ice may form on different parts of the heat pump. For example, ice may accumulate on an outdoor coil housing, a fan, and/or an outdoor coil. The ice may cause noise and/or inhibit the ability of various parts of the heat pump to function during operation.

BRIEF SUMMARY OF THE INVENTION

In various implementations, an ice accumulation surface of an ice sensor that is coupled to at least a portion of a heat pump may be exposed to an area proximate the heat pump, a heater(s) of the ice sensor may provide heat to the exposed ice accumulation surface, one or more temperatures of the ice accumulation surface may be determined, and a determination may be made whether ice is present on the ice accumulation surface based at least partially on at least one of the determined temperatures.

Implementations may include one or more of the following features. In some implementations, at least one defrost cycle may be allowed if ice is present on the ice accumulation surface. In some implementations, at least one defrost cycle may be restricted if ice is not present on the ice accumulation surface. Determining one or more temperatures of the ice accumulation surface may include determining a first temperature of the ice accumulation surface at a first predetermined time, and making a determination if ice is present on the ice accumulation surface may include determining if the first temperature is within a predetermined range of temperatures for the first predetermined time. Determining whether ice is present on the ice accumulation surface may include determining a slope based at least partially on at least two of the determined temperatures. The slope may include a change in temperature over a period of time. Ice may be present on the ice accumulation surface if the slope is less than approximately 18 degrees Fahrenheit/minute. Determining whether ice is present on the ice accumulation surface may include determining slope(s) based at least partially on at least two of the determined temperatures, and determining if ice is present on the ice accumulation surface may be at least partially based on a difference between the determined slope(s).

In some implementations, an amount of time that the heat has been provided to the ice accumulation surface may be determined, and the ice sensor may be restricted from providing heat if the amount of time is greater than a predetermined maximum operation amount of time. In some implementations, the ice sensor may be restricted from providing heat to the ice accumulation surface if at least one of the determined temperatures of the ice accumulation surface is greater than a predetermined maximum temperature.

In various implementations, a system may include a heat pump and an ice sensor. The ice sensor may include an ice accumulation surface, heater(s), and temperature sensor(s). The heater(s) may provide heat to the ice accumulation surface. Temperature sensor(s) may determine at least one temperature of the ice accumulation surface. The ice sensor may detect ice on the ice accumulation surface based at least partially on at least one of the determined temperatures. The heat pump may allow at least one defrost operation when ice is detected on the ice accumulation surface of the ice sensor.

Implementations may include one or more of the following features. The ice sensor may be disposed proximate a portion of the heat pump. The ice sensor may be coupled to a portion of the heat pump. In some implementations, the ice sensor may be coupled to the outdoor coil portion of the heat pump. The ice sensor may include a body adapted to couple to at least a portion of the heat pump.

In various implementations, an ice sensor for a heat pump may include an ice accumulation surface, heater(s), and temperature sensor(s). The heater(s) may be coupled to the ice accumulation surface and may provide heat to the ice accumulation surface. The temperature sensor(s) may determine at least one temperature of the ice accumulation surface. The ice sensor may determine whether ice is present on the ice accumulation surface based at least partially on at least one of the determined temperatures.

Implementations may include one or more of the following features. In some implementations, at least one of the temperature sensors may be coupled proximate an end of the ice sensor, and at least one of the heaters may be coupled proximate an opposite end of the ice sensor. In some implementations, the ice sensor may include an at least partially hollow housing, and the ice accumulation surface may comprise the outer surface of the housing. At least one of the temperature sensors and at least one of the heaters may include a positive temperature coefficient heater. In some implementations, the ice sensor may include an at least partially hollow housing in which the ice accumulation surface may comprise the outer surface of the housing, and at least one of the temperature sensors and at least one of the heaters may include a positive temperature coefficient heater. The positive temperature coefficient heater(s) may be disposed at least partially in the housing. The ice sensor may include a body, and the body may include a conductive material. The ice accumulation surface may include at least a portion of the body. The ice sensor may include a coupling member to couple the ice sensor to at least a portion of a heat pump.

The details of one or more implementations are set forth in the accompanying drawings and the description below. Other features, objects, and advantages of the implementations will be apparent from the description and drawings.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION OF THE INVENTION

Figure 1A:
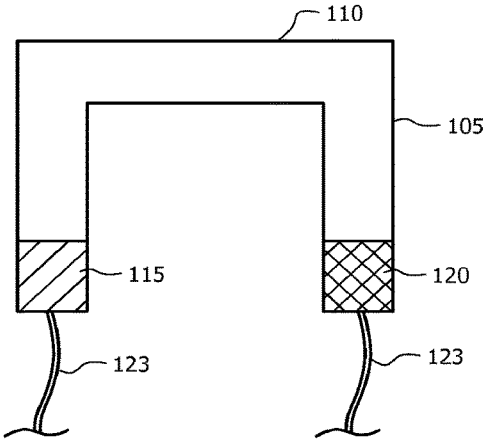
FIG. 1A illustrates an implementation of an example ice sensor.

In various implementations, an ice sensor may monitor conditions and determine if ice is present proximate a surface of the ice sensor. The ice sensor may include an ice accumulation surface, one or more heater(s), and one or more temperature sensor(s).

The ice accumulation surface may be a portion of the ice sensor. For example, the ice accumulation surface may be a surface of the ice sensor. In some implementations, the ice sensor may include a body (e.g., a solid body, a hollow body, and/or a housing), and the ice accumulation surface may include at least a portion of a surface of the body. The body may include a material capable of transferring heat and/or a material that is not insulated. For example, the body may include at least a portion made of copper and/or other conductive material. In some implementations, the body may include a material that has a heat loss characteristic that changes when surrounded by air, water, and/or ice (e.g., the heat loss may be monitored to determine the presence of ice on the ice accumulation surface).

The heater(s) may include any appropriate device for generating and/or providing heat. For example, the heater may include a resistor and/or a positive temperature coefficient (PTC) heater. The heater may provide heat to at least a portion of the ice accumulation surface.

The temperature sensor(s) may include any appropriate device that measures temperature and/or temperature gradients (e.g., thermometer, thermocouple, and/or PTC heater). In some implementations, the ice sensor may include a member to which the heater and/or the temperature sensor(s) may be coupled.

In some implementations, a heater and a temperature sensor may be a combined unit, such as when using a PTC heater. A PTC heater may include a material in which, as the temperature increases, the resistance of the material increases and a current passing through the material decreases. Thus, when the PTC heater applies heat to the PTC material, the decrease in the current that passes through the PTC material may be measured. In particular, as the temperature rises in the PTC material due to the application of heat from the PTC heater, the resistance of the material increases and a current drop may be measurable over the PTC material. The measured current (e.g., the change in the measured current) may be used to determine the temperature (e.g., absolute and/or change in temperature) of the PTC heater and/or temperature sensor.

In some implementations, the ice sensor may restrict operations to inhibit damage to portions of the ice sensor, portions of the heat pump to which the ice sensor is coupled, and/or to users proximate the ice sensor (e.g., to inhibit users from getting burns when touching a surface of the ice sensor). For example, a PTC heater may be self-limiting and restricted from overheating, which may increase the safety of the use of the device during operations (e.g., by decreasing chances of increased heat related issues, such as burning users and/or damage to parts).

Figure 1B:
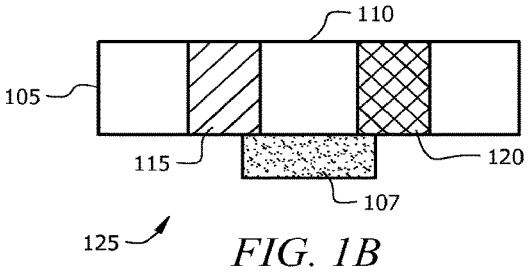
FIG. 1B illustrates an implementation of an example ice sensor.
Figure 1C:
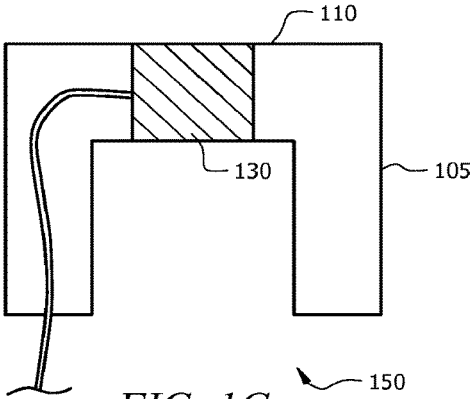
FIG. 1C illustrates an implementation of an example ice sensor.
Figure 1D:
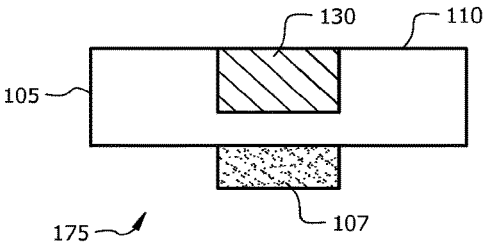
FIG. 1D illustrates an implementation of an example ice sensor.

The ice sensor may have a variety of appropriate shapes and/or configurations. FIGS. 1A through 1D illustrate various implementations of example ice sensors 100, 125, 150 and 175, respectively. Each of the ice sensors 100, 125, 150, 175 may include a body 105. The body 105 may have any appropriate shape. For example, the body 105 may include linear and/or curved portions. The body 105 may include a U-shaped tube, as illustrated in FIGS. 1A and 1C. The body 105 may include a planar member, as illustrated in FIGS. 1B and 1D.

In some implementations, as illustrated in FIGS. 1B and 1D, the body 105 may comprise and/or be coupled to a coupling member 107, such as a clip, adhesive, and/or a hook. The coupling member 107 may couple the ice sensor 125, 175 to a portion of a heat pump, such as a grate of a housing of an outdoor coil, a housing of a heat exchanger, a surface of the heat exchanger, and/or a housing of a fan.

Each of the ice sensors 100, 125, 150, 175 may include an ice accumulation surface 110 that forms a portion of the body 105. The body 105 of the ice sensors 100, 125, 150, 175 may include an upper linear portion. The ice accumulation surface 110 may include a surface of at least a portion of the upper linear portion. When the ice accumulation surface 110 is exposed to an environment proximate a heat pump, ice may form on at least a portion of the ice accumulation surface 110 and ice may also accumulate on a surface of the heat pump to which the ice sensor 100, 125, 150, 175 is proximate. Thus, ice on an ice accumulation surface 110 (e.g., when ice is detected by the ice sensor 100, 125, 150, 175) may indicate ice accumulation on a surface of the heat pump and the heat pump may allow appropriate operations (e.g., defrost and/or other operations).

As illustrated in FIGS. 1A and 1B, in some implementations, heater(s) 115 and temperature sensor(s) 120 may be coupled to and/or disposed at least partially on/in the body 105. As illustrated in FIG. 1A, a heater 115 may be coupled proximate an end of the body 105 of the ice sensor 100 and a temperature sensor 120 may be coupled proximate an opposite end of the body 105 of the ice sensor 100. As illustrated in FIG. 1B, a heater 115 and a temperature sensor 120 may be disposed within the body 105 proximate the ice accumulation surface 110.

Wires 123 may couple the heater 115 and/or the temperature sensor 120 to a power source and/or controller (e.g., dedicated controller for the ice sensor 100, 125 and/or shared controller with the heat pump). The controller (e.g., computer) may perform various operations of the ice sensor 100, 125, such as operating with the temperature sensor 120 to detect temperatures, turning heater 115 on and/or off, and determining whether ice is present on the ice accumulation surface 110 using the determined temperatures.

The heater 115 may be coupled to the body 105 of the ice sensor 100, 125 such that heat generated by the heater 115 may be provided (e.g., directly and/or indirectly, such as by raising the temperature of at least a portion of the body 105 of the ice sensor 100, 125) to the ice accumulation surface 110. The heat provided by the heater 115 to the ice accumulation surface 110 may raise the temperature of the ice accumulation surface 110 and/or at least a portion of the body 105 of the ice sensor 100, 125.

The temperature sensor 120 may be coupled to the body 105 such that a temperature of the ice accumulation surface 110 may be determined. For example, the temperature sensor 120 may directly measure at least a portion of the ice accumulation surface 110 and/or an area proximate the ice accumulation surface 110.

Although a specific implementation of coupling the temperature sensor 120 has been illustrated, in some implementations, the temperature sensor may be coupled to the ice accumulation surface 110 in other appropriate ways.

As illustrated in FIGS. 1C and 1D, in some implementations, the ice sensor 150, 175 may include an integrated heater and temperature sensor 130. For example, the integrated heater and temperature sensor 130 may include a PTC heater. The integrated heater and temperature sensor 130 may include heater(s) and temperature sensor(s) disposed at least partially in a housing. The integrated heater and temperature sensor 130 may be coupled to and/or disposed at least partially in the body 105 of the ice sensor 150, 175.

Wire 123 may couple the integrated heater and temperature sensor 130 to a power source and/or controller (e.g., dedicated controller for the ice sensor 150, 175 and/or shared controller with the heat pump). The controller (e.g., computer) may perform various operations of the ice sensor 150, 175, such as turning the heater on and/or off, detecting temperatures, and determining whether ice is present on the ice accumulation surface 110 using the determined temperatures.

In some implementations, the integrated heater and temperature sensor 130 may be disposed proximate the ice accumulation surface 110. For example, the integrated heater and temperature sensor 130 may be disposed proximate a center of the body 105 of the ice sensor 150, 175, as illustrated in FIGS. 1C and 1D. In some implementations, the integrated heater and temperature sensor 130 may be disposed proximate an end of the body 105 and provide heat to an area proximate the ice accumulation surface 110 (e.g., to the ice accumulation surface 110 and/or to an area proximate the ice accumulation surface 110 that raises the temperature of the ice accumulation surface 110).

Figure 2:
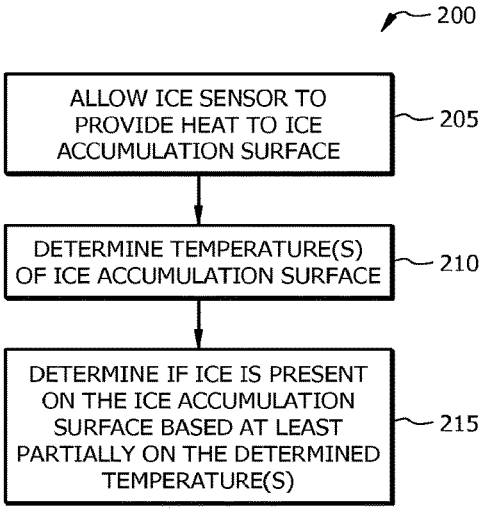
FIG. 2 illustrates an implementation of an example process for operation of an ice sensor.

The ice sensor may be utilized to detect ice events (e.g., events that may cause accumulation of ice on parts of a system) by determining if there is ice accumulation on the ice sensor. The detection of ice on the ice accumulation surface by the ice sensor may indicate ice formation conditions and/or the presence of ice on portions of a heat pump to which the ice sensor is proximate. The heat pump may allow various operations (e.g., defrost and/or other operations) when the ice sensor determines that ice accumulation is present and/or not present. FIG. 2 illustrates an implementation of an example process 200 for detecting ice accumulation on the ice sensor.

The ice sensor may be allowed to provide heat to an ice accumulation surface (operation 205). For example, a heater may generate heat to directly and/or indirectly provide heat to the ice accumulation surface. In some implementations, the heater may raise the temperature of the body of the ice sensor proximate the heater. As the temperature of the body of the ice sensor proximate the heater increases, the temperature of the ice accumulation surface of the body increases.

Temperature(s) of the ice accumulation surface may be determined (operation 210). For example, a temperature sensor may be coupled to the body of the ice sensor and may measure a temperature of the ice accumulation surface directly and/or indirectly. In some implementations, the temperature sensor may monitor the ice accumulation surface temperature.

A determination of whether ice is present on the ice accumulation surface may be made based at least partially on the determined temperature(s) (operation 215). For example, when ice is present on the ice accumulation surface, the rate at which the temperature of the ice accumulation surface rises due to the heat provided by the heater(s) is less than when ice is not present on the ice accumulation surface. Thus, by determining the temperature of the ice accumulation surface, a determination may be made whether ice is present on the ice accumulation surface.

In some implementations, a temperature of the ice accumulation surface may be monitored and compared to a predetermined range of values. When the temperature of the ice accumulation surface is within a predetermined range of values, a determination may be made that ice is present on the ice accumulation surface.

In some implementations, a temperature of the ice accumulation surface may be determined at time T1, a predetermined time after the application of heat to the ice accumulation surface. If the determined temperature at time T1 is within a predetermined range of values, then a determination may be made that ice is present on the ice accumulation surface.

In some implementations, a change in temperature over time (e.g., a slope of a graph of temperature over time) may be monitored. The change in temperature over time may be compared to a predetermined value for the slope (e.g., change in temperature over a time period). When the determined slope is greater than a predetermined value for the slope, a determination may be made that ice is not present on the ice accumulation surface. For example, when the change in temperature over time for a predetermined period of time is greater than approximately 18 degrees Fahrenheit/minute, then ice may not be present on the ice accumulation surface. The predetermined period of time may be a time period after the initial application of heat by the heater (e.g., after 30 seconds). In some implementations, when the slope for a predetermined time (e.g., after application of heat by the heater) is less than approximately 18 degrees Fahrenheit/minute, then the ice sensor may determine that ice is present on the ice accumulation surface.

In some implementations, a change in temperature over a period of time may be monitored, and a value for a slope (e.g., change in temperature over time) may be determined. A determination of whether ice is present on the ice accumulation surface may be made based on changes in the determined slopes.

In some implementations, a function based on the determined temperatures over time may be determined (e.g., may be plotted as a graph) and a shape of the function may be determined. The determination of whether ice is present on the ice accumulation surface may be based at least partially on the function. For example, a temperature change of the ice accumulation surface may not substantially change for a period of time (e.g., at approximately 32 degrees Fahrenheit during the phase change of the ice present on the ice accumulation surface, the slope of temperature measured in degrees Fahrenheit versus time measured in minutes may be approximately zero) if ice is present on the ice accumulation surface.

Process 200 may be implemented by various systems, such as systems 100, 125, 150, and/or 175. In addition, various operations may be added, deleted, and/or modified. For example, the heater may directly provide heat to the ice accumulation surface. As another example, the temperature sensor may measure an area proximate the ice accumulation surface. The temperature of the ice accumulation surface may be determined based on the measured temperature.

In some implementations, the ice sensor may be activated based on environmental conditions. For example, when the temperature, pressure, and/or moisture of the ambient air proximate a portion of a heat pump (e.g., outdoor coil) and the measured properties are within predetermined property values, the ice sensor may be activated. In some implementations, the ice sensor may be activated when a heat cycle (e.g., generating hot air for delivery to a location and/or when the outdoor coil of the heat pump acts as a evaporator) of a heat pump is activated.

In some implementations, the ice sensor may be utilized to detect ice accumulation conditions. For example, when a heat pump operates in cold environments (e.g., outdoor coils of an air conditioner in cold environments and/or refrigeration applications), ice accumulation may occur. The ice accumulation may decrease the efficiency of the heat pump, interfere with operations, and/or restrict operations (e.g., fan operation due to an ice bridge formation in the orifice). The determination by the ice sensor of whether ice is present may be utilized by the heat pump to reduce the amount of ice and/or prevent the formation of ice on portions of the heat pump.

Figure 3:
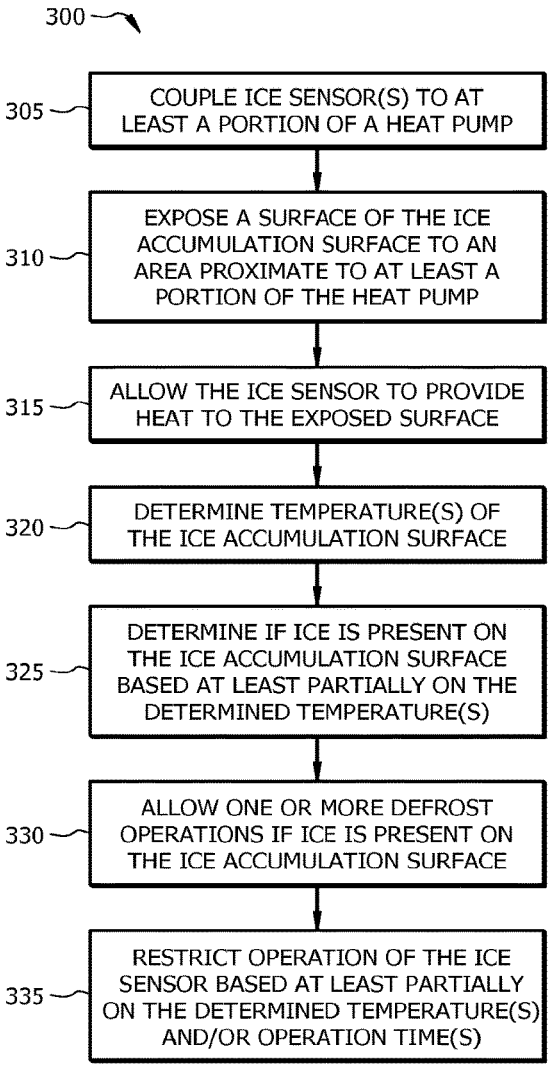
FIG. 3 illustrates an implementation of an example process for using an ice sensor.

FIG. 3 illustrates an implementation of an example process 300 for using an ice sensor. An ice sensor may be disposed in an environment, such as proximate an outdoor coil of a heat pump. The ice sensor may be coupled to at least a portion of a heat pump (operation 305). The shape of the ice sensor (e.g., a U-shaped sensor) may allow the ice sensor to be coupled to and/or disposed on a housing of a heat pump. For example, a U-shaped ice sensor may be disposed across a grate of a housing of an outdoor coil. In some implementations, the ice sensor may be clipped or otherwise coupled to the housing of at least a portion of the heat pump.

At least a portion of the ice accumulation surface may be exposed to an area proximate at least a portion of the heat pump (operation 310). For example, the ice accumulation surface may be exposed to ambient air and/or subject to the environmental conditions that may cause ice to accumulate on at least a portion of the heat pump.

The ice sensor may be allowed to provide heat to the exposed ice accumulation surface (operation 315). For example, heater(s) may generate heat. The heat generated may be provided to the exposed ice accumulation surface (e.g., the heat may be provided directly to the ice accumulation surface and/or the heat may be provided indirectly by heat transfer at least partially through the body).

Temperature(s) of the ice accumulation surface may be determined (operation 320). For example, temperature sensor(s) (e.g., of the PTC heater and/or thermocouple) may monitor and/or determine the temperature(s) of the ice accumulation surface.

A determination may be made whether ice is present on the ice accumulation surface based at least partially on the determined temperature(s) (operation 325). For example, a determination of whether ice is present may be based on change(s) in temperature, change(s) in temperature over time, temperature at a predetermined time, change(s) in temperature over time at a predetermined time and/or temperature, etc. In some implementations, a slope (e.g., a ratio of the change in temperature over a change in time) may be determined based on the change in determined temperatures over time and may be measured at a predetermined time and/or temperature. A determination may be made that ice may be present if the slope is less than approximately 18 degrees Fahrenheit/minute.

One or more defrost operations may be allowed if ice is present on the ice accumulation surface (operation 330). For example, defrost operations of a heat pump may include energizing or de-energizing a reversing valve of the heat pump, heating part(s) of the heat pump, applying a de-icing spray on part(s) of the heat pump, and/or allowing a supplemental defrost operation, such as the supplemental defrost operations described in U.S. patent application Ser. No. 13/690,645 to Qu, et al. entitled "Secondary Defrost for Heat Pumps" (Attorney File No. P120046 (1655.1100)) filed on Nov. 30, 2012. In some implementations, other operations may be allowed if a determination is made that ice is present on the ice accumulation surface.

An operation of the ice sensor may be restricted based at least partially on the determined temperature(s) and/or operation time(s) (operation 335). For example, when a determined temperature of the ice accumulation surface exceeds a predetermined maximum temperature, the operation of the heater may be restricted such that heat is not allowed to pass to the ice accumulation surface. In some implementations, the time the ice sensor or portions thereof (e.g., heater) operate may be monitored. When a monitored time exceeds a predetermined maximum operational time, operation of the ice sensor may be restricted, such as by restricting operation of the heater. Operation(s) of the ice sensor may be restricted to inhibit temperatures of the ice sensor or portions thereof from exceeding a predetermined temperature (e.g., to inhibit burning users and/or to inhibit wear on heat pump part(s) and/or ice sensor part(s) due to excessive heat). In some implementations, operations of the ice sensor may be restricted based at least partially on determined temperature(s) and/or operational time(s) to allow the ice sensor to re-acclimate to an environment the ice sensor is exposed to such that the ice sensor can be activated again to determine if ice is accumulating (e.g., if the heater is allowed to elevate temperatures of the ice sensor, then ice may not accumulate on the sensor although it may accumulate proximate the sensor).

Process 300 may be implemented by various systems, such as systems 100, 125, 150, and/or 175. In addition, various operations may be added, deleted, and/or modified. In some implementations, process 300 may be performed in combination with other processes, such as process 200. For example, various modes of the heat pump may be allowed based at least partially on whether ice is present and/or not present on the ice accumulation surface. In some implementations, when ice is not present on the ice accumulation surface, a defrost operation of the heat pump may be restricted and/or turned off. In some implementations, when ice is not present on the ice accumulation surface, a heat pump may be allowed to perform normal operations (e.g., provide heat according to a user request). In some implementations, a determination that ice is present on an ice accumulation surface may be made by determining temperature(s) at a predetermined time (e.g., after application of heat by a heater, such as 30 seconds after activation of the ice sensor). The determined temperatures may be compared to a predetermined range of values to determine whether ice is present on the ice accumulation surface. In some implementations, a determination of whether ice is present on the ice accumulation surface may be based on monitoring the time required to elevate the temperature of the ice accumulation sensor over 32 degrees Fahrenheit (e.g., since an ice sensor with ice accumulation may take longer to reach a temperature greater than 32 degrees Fahrenheit than an ice sensor without ice accumulation).

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "material" includes a combination of two or more materials and reference to "a heater" includes different types and/or combinations of heaters. Reference to "an ice sensor" may include a combination of two or more ice sensors. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method comprising:

exposing an ice accumulation surface of an ice sensor coupled to at least a portion of a heat pump to an area proximate the heat pump, wherein the ice sensor includes one or more heaters and one or more temperature sensors, the one or more heaters separated from the one or more temperature sensors by the ice accumulation surface;

using the one or more heaters of the ice sensor to provide heat to the exposed ice accumulation surface, wherein the one or more heaters comprises a positive temperature coefficient heater;

determining one or more temperatures of the ice accumulation surface using the one or more temperature sensors at different times;

determining if ice is present on the ice accumulation surface based on a change in temperature over time;

running at least one defrost cycle if ice is present on the ice accumulation surface; and restricting operation of the ice sensor if one of the one or more temperatures of the ice accumulation surface that separates the one or more heaters from the one or more temperature sensors exceeds a predetermined temperature, wherein restricting operation of the ice sensor comprises lowering heat provided to the ice accumulation surface.

2. The method of claim 1 further comprising monitoring an operational time of the ice sensor.

3. The method of claim 1 further comprising restricting at least one running defrost cycle of the heat pump if ice is not present on the ice accumulation surface.

4. The method of claim 1 wherein determining whether ice is present on the ice accumulation surface comprises:

determining a slope based at least partially on at least two of the determined temperatures, wherein the slope comprises a change in temperature over a period of time; and wherein ice is present on the ice accumulation surface if the slope is less than approximately 18 degrees Fahrenheit/minute.

5. The method of claim 1 wherein determining whether ice is present on the ice accumulation surface comprises:

determining one or more slopes based at least partially on at least two of the determined temperatures, wherein a slope comprises a change in temperature over a predetermined period of time; and wherein determining if ice is present on the ice accumulation surface is at least partially based on one or more of the determined slopes.

6. The method of claim 1 further comprising:

determining an amount of time that the heat has been provided to the ice accumulation surface; and lowering the amount of heat provided by the ice sensor if the amount of time is greater than a predetermined maximum operation amount of time.

7. The method of claim 1, wherein restricting operation of the ice sensor if one of the one or more temperatures of the ice accumulation surface that separates the one or more heaters from the one or more temperature sensors exceeds the predetermined temperature further comprises:

allowing the ice sensor to re-acclimate to the environment; and activating the re-acclimated ice sensor in order to determine if ice is still present on the ice accumulation surface.

8. A system comprising:

a heat pump adapted to perform at least one defrost operation; and an ice sensor comprising:

a U-shaped tube;

an ice accumulation surface; and one or more heaters at one end of the U-shaped tube and adapted to provide heat to the ice accumulation surface, the one or more heaters coupled to one or more temperature sensors at the other end of the U-shaped tube, wherein the one or more temperature sensors are separated from the one or more heaters by the ice accumulation surface, and the one or more temperature sensors are adapted to determine at least one temperature of the ice accumulation surface at different times;

wherein the ice sensor is adapted to detect ice on the ice accumulation surface based on a change in temperature over time; and wherein the heat pump is operable to perform at least one defrost operation when ice is detected on the ice accumulation surface of the ice sensor and wherein the heat pump is operable to restrict operation of the ice sensor if one of the at least one temperatures of the ice accumulation surface that separates the one or more heaters from the one or more temperature sensors exceeds a predetermined temperature, wherein restricting operation of the ice sensor comprises lowering heat provided to the ice accumulation surface.

9. The system of claim 8, wherein the one or more heaters comprises a positive temperature coefficient (PTC) heater.

10. The system of claim 8 wherein the ice sensor is coupled to a portion of the heat pump.

11. The system of claim 10 wherein the portion of the heat pump comprises the outdoor coil.

12. The system of claim 8 wherein the ice sensor comprises a body adapted to couple to at least a portion of the heat pump.

13. An ice sensor for a heat pump, the ice sensor comprising:

an ice accumulation surface; and one or more heaters coupled to the ice accumulation surface and adapted to provide heat to the ice accumulation surface, the one or more heaters coupled to one or more temperature sensors, wherein the one or more temperature sensors are separated from the one or more heaters by the ice accumulation surface, and the one or more temperature sensors are adapted to determine at least one temperature of the ice accumulation surface at different times and coupled to one or more current sensors adapted to determine the current passing through the one or more heaters at different times;

wherein the ice sensor determines whether ice is present on the ice accumulation surface based on a change in temperature over time; and wherein the heat pump is operable to perform at least one defrost operation when ice is detected on the ice accumulation surface of the ice sensor and wherein the heat pump is operable to restrict operation of the ice sensor if one of the at least one temperatures of the ice accumulation surface that separates the one or more heaters from the one or more temperature sensors exceeds a predetermined temperature, wherein restricting operation of the ice sensor comprises lowering heat provided to the ice accumulation surface.

14. The ice sensor of claim 13 wherein at least one of the temperature sensors is coupled proximate an end of the ice sensor, and wherein at least one of the heaters is coupled proximate an opposite end of the ice sensor.

15. The ice sensor of claim 13, wherein the one or more heaters comprises a positive temperature coefficient (PTC) heater.

16. The ice sensor of claim 13 wherein at least one of the temperature sensors and at least one of the heaters comprises a positive temperature coefficient heater.

17. The ice sensor of claim 13 further comprising an at least partially hollow housing, wherein the ice accumulation surface comprises an outer surface of the housing, wherein at least one of the temperature sensors and at least one of the heaters comprises a positive temperature coefficient heater, and wherein at least one of the positive temperature coefficient heaters is disposed at least partially in the housing.

18. The ice sensor of claim 13 further comprising a body, wherein the body comprises an electrically conductive material, and wherein the ice accumulation surface comprises at least a portion of the body.

19. The ice sensor of claim 13 further comprising a coupling member adapted to couple the ice sensor to at least a portion of a heat pump.

* * * * *